United States Patent [19]

Shumate

[11] 4,311,444

[45] Jan. 19, 1982

[54] PRESSURE-BALANCING END PLATE FOR A REVERSIBLE GEAR PUMP OR MOTOR

[76] Inventor: Donald L. Shumate, 1296 Frost Rd., Streetsboro, Ohio 44240

[21] Appl. No.: 99,413

[22] Filed: Dec. 3, 1979

Related U.S. Application Data

[63] Continuation of Ser. No. 31,545, Apr. 19, 1979, abandoned.

[51] Int. Cl.[3] ..... F03C 2/08; F04C 2/18; F04C 15/00

[52] U.S. Cl. ..... 418/74; 418/78; 418/131

[58] Field of Search ..... 418/71, 74, 78, 131, 418/132, 135

[56] References Cited

U.S. PATENT DOCUMENTS

| | | | |
|---|---|---|---|
| 2,310,078 | 2/1943 | Herman | 418/74 |
| 2,714,856 | 8/1955 | Kane | 418/132 |
| 3,833,319 | 9/1974 | Eglington | 418/132 |
| 4,087,216 | 5/1978 | Shumate | 418/74 |
| 4,239,468 | 12/1980 | Smith | 418/78 |

FOREIGN PATENT DOCUMENTS

| | | | |
|---|---|---|---|
| 205566 | 1/1968 | U.S.S.R. | 418/131 |

*Primary Examiner*—John J. Vrablik

*Attorney, Agent, or Firm*—Watts, Hoffmann, Fisher & Heinke Co.

[57] ABSTRACT

A reversible gear pump or motor capable of sustained operation under unusually high pressure conditions is provided with a unique diverter plate having pressure-transmitting paths in the ends of the plate which open to the gear teeth on both the high and low pressure sides of the pump or motor. In operation, the high pressure is transmitted through the specially formed paths to areas of the gears on the low pressure side. The pressure acts as a counter force which pushes the gears towards a centered position and reduces bearing loads without increasing the pressure forcing the gears towards one another.

9 Claims, 5 Drawing Figures

PRESSURE-BALANCING END PLATE FOR A REVERSIBLE GEAR PUMP OR MOTOR

CROSS-REFERENCE TO RELATED APPLICATION

This application is a continuation of copending application Ser. No. 31,545 entitled "Diverter Plates", filed Apr. 19, 1979, now abandoned. The disclosure of application Ser. No. 31,545 is incorporated by reference.

BACKGROUND OF THE INVENTION

The present invention relates generally to gear-type pumps and motors, and more specifically to reversible spur gear pumps or motors capable of operating under high pressure conditions.

Reversible gear pumps or motors of the type described include intermeshed spur gears rotatably mounted in a housing between a low pressure port and a high pressure port. Pressure plates are often provided in the housing at the ends of the gears. These plates include two circular portions having shaft receiving holes therethrough to define a figure-eight configuration. The purpose of the pressure plates is to confine the liquid in the gear chamber and improve the efficiency of the pump.

When in operation, the pressure differential existing between the low pressure and the high pressure sides of such a pump or motor places an unbalanced loading on the gears which can lead to wear, decreased efficiency and eventual failure. Under high pressure conditions, the unbalanced loading forces the gears against the inner surfaces of the housing at the low pressure side of the pump or motor. The surfaces of the housing are rapidly worn away by the pressure contact of the rotating gear teeth and the operating efficiency of the pump or motor is diminished until it eventually fails. High pressure deflection of the gear sets and shafts also produces severe bearing wear which in turn contributes to the movement of the gears against the housing wall at the low pressure side and aggravation of the wear problem.

Various attempts have been made in the past to counterbalance the high pressure loading on the gears of reversible pumps. Some of these proposals entailed a complicated and expensive housing construction having drilled or cored passageways, relief areas in the housing wall, etc. In many instances the construction has been such as to permit high pressure liquid to leak around the gears to the low pressure side of the pump or motor so as to diminish its operating efficiency. Another problem of certain prior art structures was the creation of high pressure hydraulic loading on the top and bottom of the gear set. The hydraulic loading acted to force the gears together and load the bearings, thereby producing severe bearing wear. Still another problem of some prior art constructions was that cavitation could occur on the faces of the pressure plates with the result that the plates were eroded or pitted.

A commercially successful, non-reversible gear pump capable of high pressure operation is disclosed in U.S. Pat. No. 4,087,216. The pump of that patent includes a pair of flow diverter plates that are effective to reduce severe unbalanced pressure loading on the gears. In a preferred embodiment of the diverter plate, a cavity or recess is formed in the outer peripheral edge of each circular plate portion. The two recesses are located on the same side of the centerline extending diametrically through the shaft receiving holes of the circular portions. A channel or the like is formed in the outer peripheral edge of each circular portion between the sides of the plate so as to extend from the recess therein to a terminating location on the other side of the centerline. The diverter plates are fitted into the pump housing so that the recesses are on the low pressure side of the pump or motor and the channels terminate on the high pressure side. During operation, the high pressure fluid is communicated through the channels to the low pressure side. The fluid pressure acts as a counterforce to at least partially balance the high pressure side loading and push the gears back towards a centered position. This allows the gears to function properly while minimizing bearing levels.

Operation of non-reversible pumps provided with diverter plates as described in U.S. Pat. No. 4,087,216 has shown that the diverter plate construction materially reduces bearing failure and wear of the pump housing. Such pumps have been operated at pressures up to 5,000 p.s.i. or higher for extended periods of time compared to the relatively short life of conventional gear pumps under the same operating conditions.

SUMMARY OF THE INVENTION

The purpose of the present invention is to provide a reversible pump or motor which has all of the advantages of the non-reversible construction disclosed in U.S. Pat. No. 4,087,216, especially the capability of operating under high pressure conditions.

The invention is characterized by a novel diverter plate that significantly reduces unbalanced hydraulic loading forces on the gears and bearings in either direction of gear rotation. The bearing life is improved and gear tracking and other wear problems caused by unbalanced hydraulic side loading forces are minimized. These and other advantages are attained in a reversible pump or motor capable of operating at pressures up to 5000 p.s.i. or higher.

The pressure-balancing diverter plate structure of the invention comprises two generally circular portions with shaft receiving holes therethrough defining a figure-eight configuration including a throat area on each side of the plate structure. Each circular plate portion has a gear tooth-confronting face region and a pressure-transmitting path extending between terminating locations on either side of an imaginary line extending through the centers of the holes. The terminating locations are open on the gear tooth-confronting face regions and are circumferentially spaced from the throat areas. The terminating locations are formed to communicate with interdental areas at the ends of the gears so that high pressure can be transmitted to the low pressure side of the gears to bias them towards a centered position.

In one exemplary embodiment, the diverter plate structure is a unitary member. The pressure-transmitting path in each circular portion of the unitary plate comprises a channel formed in the outer peripheral edge of the circular portion, the channel being spaced from the faces of the plate to provide sealing lands along either side of the channel engageable with the walls of a pump or motor housing. In the illustrated embodiment, the terminating locations of each channel comprise circumferentially spaced recesses formed in the gear tooth-confronting regions of each circular portion.

In use, one and preferably two diverter plates are fitted into the pump or motor housing in the usual manner at the ends of the gears. When the pump or motor is actuated, the gear set will move slightly under the loading of high pressure fluid toward the low pressure side of the pump or motor. This slight amount of movement of the gear set communicates the high pressure fluid over the outer diameter of the gear teeth to the recesses on the high pressure side. The high pressure is then transmitted via the channels to the terminating locations or recesses on the low pressure side. The high pressure communicated on the low pressure side acts on the gears to counteract unbalanced high pressure hydraulic loading on the gears and minimize shaft deflection and side loading of the bearings.

A key feature of this invention is the construction of the diverter plates which permits the direction of gear rotation to be reversed. When the direction of gear rotation is reversed, the high pressure side of the pump or motor becomes the low pressure side and vice versa. The gear set will shift slightly toward the low pressure side to permit the high pressure to enter the channels or other pressure-transmitting paths and be communicated to the low pressure side of the pump or motor. As before, the high pressure acting on the gears on the low pressure side tends to reduce unbalanced loading of the gears and bearings.

The preferred pump construction includes a diverter plate at each end of the gear chamber. The use of two plates at the ends of the gears reduces the eroding effects of cavitation. The high pressure transmitted via the plate recesses and connecting channels to the low pressure side of the pump or motor is communicated to both ends of the interdental gear spaces. Any entrained gas bubbles are forced away from the faces of the diverter plates so that they will not be damaged when implosion occurs.

Another feature and advantage of the invention is the simple and inexpensive construction of the new diverter plate. This construction makes it unnecessary to provide specially cored passages and recesses in the pump housing in order to obtain pressure balancing capability. The new diverter plate can be incorporated into pumps and motors of conventional design with a resulting improvement in their life and performance.

Other features and advantages and a fuller understanding of the invention will be had from the following detailed description and the accompanying drawings.

DETAILED DESCRIPTION OF THE PREFERRED EMBODIMENT

Figure 1:
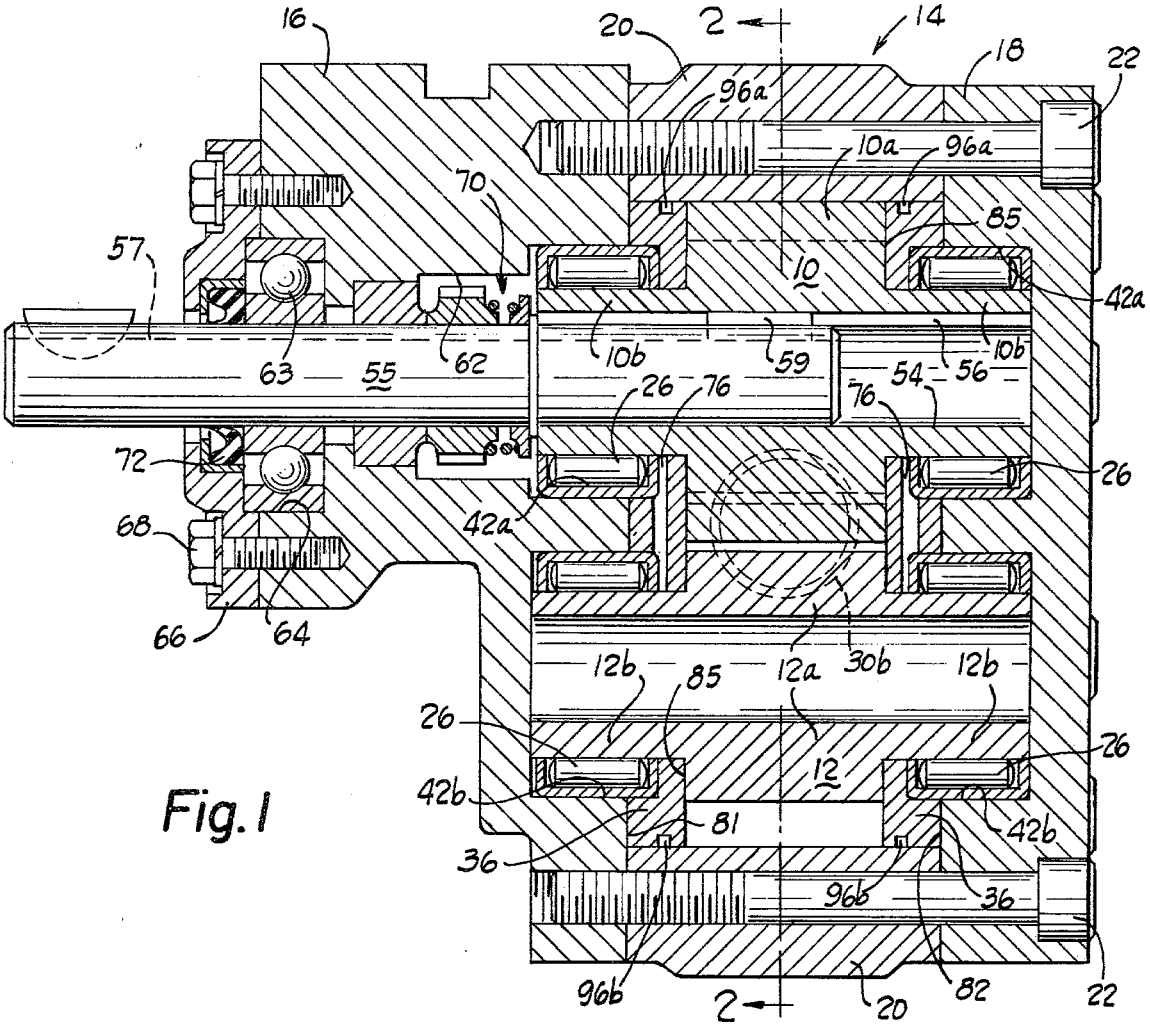
FIG. 1 is an enlarged, vertical cross-sectional view with parts in elevation of a rotary gear pump or motor taken along the line 1—1 of FIG. 2.
Figure 2:
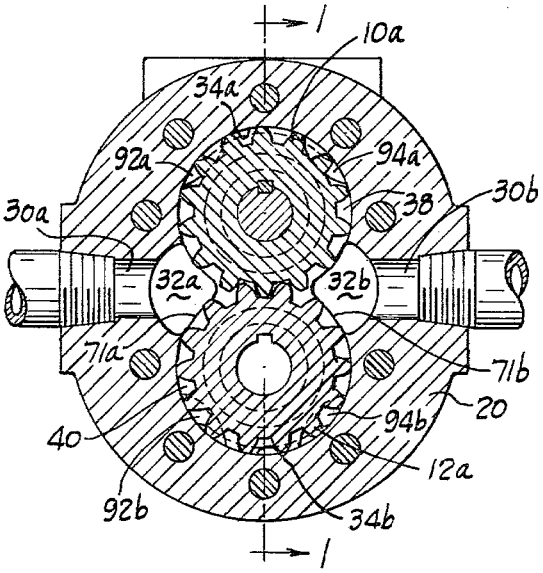
FIG. 2 is a reduced cross-sectional view taken along the line 2—2 of FIG. 1.

FIGS. 1 and 2 illustrate the overall construction of a reversible rotary gear pump which also may be used as a fluid motor. The gear pump includes intermeshed driving and driven spur gears 10, 12 rotatably supported within a pump housing assembly indicated generally by the reference character 14. The housing assembly 14 includes a front cover plate 16, a rear cover plate 18, and an intermediate housing 20 secured together by a plurality of headed and threaded fasteners 22 extending through the rear cover plate 18 and the housing 20 into threaded engagement with the front plate 16.

Each of the gears 10, 12 is rotatably supported within the housing assembly 14 by pairs of roller bearing assemblies 26. The gears 10, 12 respectively include teeth **10*a*, 12*a* and shaft portions in the form of integral hubs 10*b*, 12*b* that extend from both ends of the gears. The pair of upper roller bearing assemblies 26 which rotatably support the driving gear 10 surround the hubs 10*b*. The lower pair of roller bearing assemblies 26 engage and support the hubs 12*b* of the gear 12**.

The housing assembly 14 further includes fluid input/output ports **30*a*, 30*b* which communicate with inlet/outlet pressure chambers 32*a*, 32*b*, respectively. The intermediate housing member 20 includes arcuate surfaces 34*a*, 34*b* that conform to the periphery of the gears 10, 12**.

A pair of diverter plates 36 constructed in accordance with the invention are disposed within the intermediate housing 20 flush with the ends of the gear teeth **10*a*, 12*a* of the gears 10, 12. A pair of circular gear chambers 38, 40 are defined by the arcuate housing surfaces 34*a*, 34*b* and the diverter plates 36**.

Figure 4:
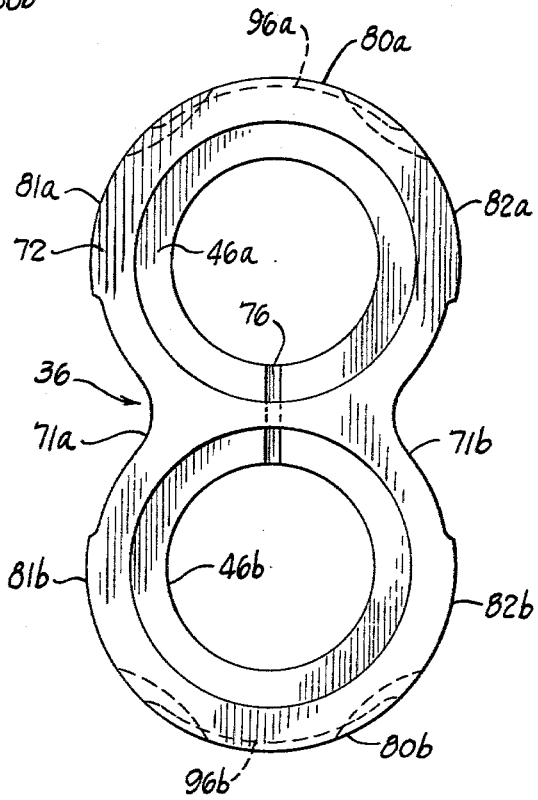
FIG. 4 is an elevational view of the reverse side of the diverter plate illustrated in FIG. 3.

The front and rear cover plates 16, 18, respectively, include upper and lower annular recesses **42*a*, 42*b* that receive the roller bearing assemblies 26. The position and location of the roller bearings within the recesses are maintained by the diverter plates 36 which also include bearing receiving recesses 46*a*, 46*b*, as best shown in FIG. 4**.

The driving gear 10 includes a through bore 54 adapted to receive a drive shaft 55. A longitudinal keyway 56 is machined into the bore 54 and a cooperating longitudinal keyway 57 is formed in the drive shaft 55. Both keyways 56, 58 accept a key 59 which serves to couple the drive shaft 55 to the gear 10 and prevent relative rotation.

The drive shaft 55 extends through an opening 62 in the front cover plate 16. The drive shaft is rotatably supported by a ball bearing assembly 63 which is held in a recess 64 machined into the outer face of the cover plate 16 by a bearing retainer 66 secured to the outer face of the cover plate 16 by a plurality of headed and threaded fasteners 68. The portion of the drive shaft 55 which extends beyond the housing assembly 14 is adapted to receive or engage a suitable drive or actuator (not shown) which imparts rotation to the drive shaft 55.

A conventional high pressure sealing assembly 70 is provided to prevent fluid leakage along the drive shaft 55 through the cover plate 16. A low pressure seal 72 prevents the escape of lubricant from the bearing 63.

Except for the diverter plates 36, the construction of the pump or motor set forth above and illustrated in the drawings is conventional and has been selected only for the purpose of describing one typical application in which the new diverter plates of the invention can be used to advantage. It is to be understood that the details of construction are subject to wide variation, as will be readily apparent to those skilled in the art, and that the new diverter plates can be employed in other rotary gear pumps and motors.

Figure 3:
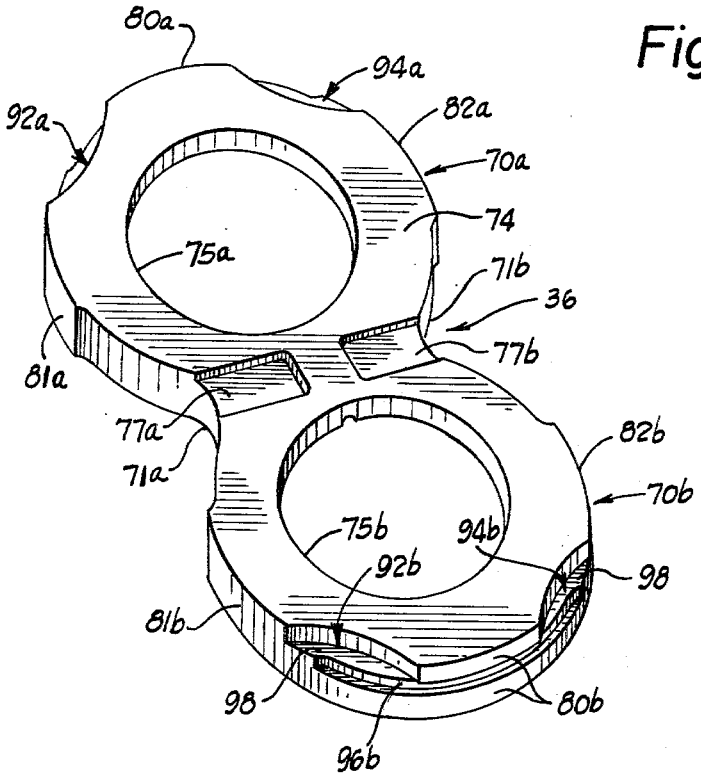
FIG. 3 is an enlarged, perspective view of the new diverter plate of this invention.

Referring to FIGS. 3 and 4, each diverter plate 36 is shown to have the usual figure-eight configuration defined by adjacent circular portions 70*a*, 70*b* having holes 75*a*, 75*b*, respectively. The circular portions 70*a*, 70*b* define throat areas 71*a*, 71*b*, at the waist of the figure-eight plate. The plate 36 also has a bearing-confronting face 72 and a gear tooth-confronting, substantially flat face 74. The roller bearing receiving recesses 46*a*, 46*b* in the face 72 are concentric with the holes 75*a*, 75*b*, respectively. As shown, the recesses 46*a*, 46*b* are communicated by a channel 76 so that fluid pressure on the side or face 72 of the plate is equalized between the circular portions 70*a*, 70*b*. A pair of spaced relief areas 77*a*, 77*b* communicating with the throat areas 71*a*, 71*b* are machined into the surface 74 between the holes 75*a*, 75*b* to allow liquid to escape from the interdental spaces of the gears 10, 12 as they mesh together.

Each circular portion 70*a*, 70*b* of the diverter plate 36 includes a pressure-transmitting path which terminates at spaced locations on either side of an imaginary line extending through the centers of the holes 75*a*, 75*b*. The terminating locations in the portion 70*a* are designated by reference numerals 92*a*, 94*a*, and the terminating locations in the portion 70*b* are designated by reference numerals 92*b*, 94*b*. In the form of the invention shown in the drawings, each of these locations is formed by a recess machined in the gear-confronting face 74. The recesses open on the outer peripheral edges of the circular plate portions and are circumferentially spaced from the throat areas 71*a*, 71*b*.

The outer peripheral edge of the circular plate portion 70*a* defines housing-engaging lands 80*a*, 81*a*, 82*a*. The land 80*a* separates the recesses 92*a*, 94*a*, and the lands 81*a*, 82*a*, are respectively located between the recesses 92*a*, 94*a* and the throat areas 71*a*, 71*b*. The outer peripheral edge of the circular portion 70*b* defines a land 81*b* between the throat area 71*a* and the recess 92*b*, a land 80*b* between the recess 92*b*, 94*b*, and a land 82*b* between the recess 94*b* and the throat area 71*b*. The several lands sealingly engage the arcuate surfaces 34*a*, 34*b* when the plates 36 are assembled in the housing 20.

In the illustrated construction, the recesses 92*a*, 94*a* are communicated by a pressure-transmitting path in the form of a channel 96*a* machined in the land 80*a*. The recesses 92*b*, 94*b* are similarly connected by a pressure-transmitting path in the form of a channel 96*b* machined in the land 80*b*. The channels 96*a*, 96*b* between the recesses 92*a*, 94*a* and the recesses 92*b*, and 94*b* are isolated from the gear chambers 38, 40 by sealing engagement between the lands 80*a*, 80*b* and the arcuate gear chamber surfaces 34*a*, 34*b*, respectively.

The direction of fluid flow through the gear pump depends on the direction of rotation of the gears 10, 12. When the driving gear 10 is rotated in the clockwise direction as viewed in FIG. 2, liquid will be pumped from the port 30*a* and the associated chamber 32*a* to the opposite chamber 32*b* and the port 30*b*. Liquid in the inlet chamber 32*a* is trapped between the arcuate surfaces 34*a*, 34*b* and the interdental spaces of the gears 10, 12 enclosed by the arcuate surfaces and is conveyed to the outlet chamber 32*b* upon rotation of the gears.

Figure 5:
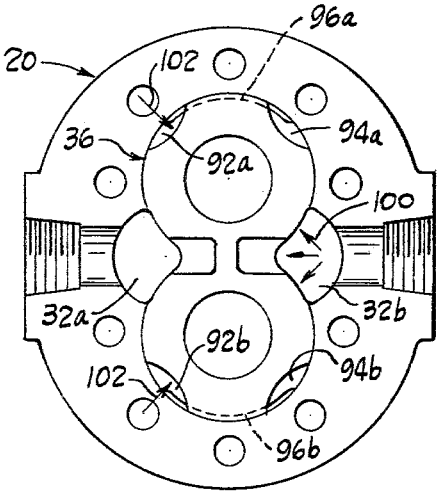
FIG. 5 is a view similar to FIG. 2, but showing the gears removed and schematically depicting the forces generated by high pressure fluid in the housing.

During operation of the pump, the pressure developed in the outlet chamber 32*b* is higher than the pressure in the inlet chamber 32*a*. The resulting pressure differential creates hydraulic side loading forces on the gears 10, 12 indicated generally by the arrows 100 in FIG. 5 tending to shift the gears laterally toward the inlet side of the pump. A slight amount of lateral gear movement may be desired to assure sealing contact between the tips of the gear teeth 10*a*, 12*a* and the inner housing surfaces 34*a*, 34*b* adjacent to the inlet chamber 32*a* and thereby prevent high pressure liquid from leaking back around the gears into the inlet chamber. As the pressure differential between the low and high pressure chambers 32, 32*b* increases, the hydraulic side loading forces on the gears must be at least partially counterbalanced to prevent the gear teeth from digging into the surfaces 34*a*, 34*b*, adjacent to the low pressure chamber 32*a* and causing gear tracking or wear of the surfaces and eventual pump failure due to excessive leakage from chamber 32*b* to chamber 32*a* around the gears. Undue movement of the gears towards the inlet chamber 32*a* also can impose severe loads on the shaft bearings 26 that will result in their wear and failure.

The new diverter plates 36 provide a means of counteracting the hydraulic side loading forces on the gears so that wear is minimized while maintaining the desired sealing contact between the gear teeth and the housing walls 34*a*, 34*b* adjacent to the low pressure chamber 32*a*. As the gears 10, 12 initially shift toward the inlet side of the pump, the pressure in the chamber 32*b* is transmitted about the ends of the gear teeth adjacent thereto to the recesses 94*a*, 94*b*. From the recesses 94*a*, 94*b*, the outlet chamber pressure is communicated through the channels 96*a*, 96*b* to the recesses 92*a*, 92*b*. As the gear teeth 10*a*, 12*a* rotate past the open recesses 92*a*, 92*b*, the interdental spaces are pressurized from both ends of the gears. This produces a force on the gears in the direction indicated by the arrows 102 in FIG. 5 which counteracts the side loading forces 100 created by the pressure in the outlet chamber 32*b*. The communication of the outlet pressure to the low pressure side of the gears also reduces side loading of the bearings and prevents excessive wear thereof which would produce further shifting of the gears against the housing surfaces 34*a*, 34*b*.

Since the counterbalancing pressure is communicated to both ends of the interdental spaces as the teeth sweep past the recesses 92*a*, 92*b* on the low pressure side of the pump, any air bubbles entrapped in the liquid are forced away from the plates 36. This reduces the pitting effects of cavitation caused by implosion of bubbles against the faces 74 of the plates.

The pressure balancing function of the plates 36 is not dependent on the direction of gear rotation. When the gear 10 is rotated counterclockwise as viewed in FIG. 2 and the gear 12 clockwise, the high pressure developed in the outlet chamber 32*a* is communicated to the cavities 94*a*, 94*b* on the inlet side of the pump. The counterbalancing forces exerted on the gears 10, 12 counteracts the high pressure side loading forces to minimize wear and damage of the pump parts, especially the housing and the bearings.

According to the preferred construction of the diverter plates 36, each of the lands 81*a*, 81*b*, 82*a*, 82*b* has an arcuate length which is slightly greater than the distance between the tips of two adjacent gear teeth. This preferred construction assures that a seal will exist between the inlet chamber and the plate recesses on the inlet side of the pump, where the recesses are isolated from the inlet chamber. Referring to FIG. 2 and assuming that liquid enters the pump through the port 30*a*, it will be seen that the leading or upstream edge of each of the pressure-balancing recesses 92*a*, 92*b* is spaced from the inlet chamber 32*a* by an arcuate distance that is slightly greater than the distance between the tips of adjacent gear teeth. This means that a tooth of each of the gears 10, 12 will be in sealing engagement with the housing surfaces 34*a*, 34*b* between the inlet chamber 32*a* and the recesses 92*a*, 92*b* at all times, whereby the liquid in the recesses 92*a*, 92*b* is prevented from leaking into the inlet chamber 32*a*. When the direction of gear rotation is reversed, the recesses 94*a*, 94*b* will be sealed from the chamber 32*b* in a similar manner.

It will be seen that the key feature of the invention is the provision for pressure communication between interdental, balancing areas of the gears, which areas are located on either side of an imaginary plane through the centers of the gears and are also spaced from the low and high pressure chambers of the pump or motor. In the illustrated embodiment, the provision for such pressure communication is accomplished by the recesses 92*a*, 92*b*, 94*a*, 94*b* and the connecting channels 96*a*, 96*b*, but other formations and arrangements for the same purpose will be apparent to those in the art. The spacing of the recesses from the throat areas of the plates is important in order to make it possible for the pump or motor to operate in either direction of gear rotation while avoiding leakage from the high pressure chamber into the low pressure of the pump or motor.

Having in mind the foregoing, many modifications and variations of the invention will be apparent to those skilled in the art. Therefore, it is to be understood that, within the scope of the appended claims, the invention can be practiced otherwise than as specifically shown and described.

What is claimed is:

1. In a pressure-balancing end plate structure for a reversible gear pump or motor, the plate structure having two circular portions each with a hole therethrough defining a figure-eight configuration including throat areas, said circular portions each having a gear tooth confronting face region, the improvement comprising a fluid pressure-transmitting path in each of said circular portions spaced from said gear tooth confronting face region and terminating in locations opening into said gear tooth conforming face region on either side of a line through the centers of said holes, said terminating locations of said paths being circumferentially spaced from said throat areas.

2. The improvement as claimed in claim 1 wherein said terminating locations in each circular portion are equidistant from said line.

3. The improvement as claimed in claim 2 in which said terminating locations of each fluid pressure-transmitting path comprise recesses in said gear tooth-confronting face regions, said recesses being open on the peripheral edges of said plate structure.

4. The improvement as claimed in claim 1, 2 or 3 wherein said fluid pressure transmitting paths are in the outer peripheral edges of said circular portions.

5. The improvement as claimed in claim 1, 2 or 3 wherein said fluid pressure-transmitting paths comprise channels in the outer peripheral edges of said circular portions, said channels being spaced from the faces of said plate structure to provide sealing lands along either side of said channels engageable with the inside walls of a pump or motor housing.

6. In a reversible fluid pump or motor including a housing having first and second ports, intermeshed gears in said housing cooperable to move fluid from one port to the other, and a pressure-balancing end plate structure fitted in said housing next to the ends of said gears and having two circular portions, each with a hole therethrough defining a figure-eight configuration including throat areas, said circular portions each having a gear tooth confronting face region, the improvement comprising a fluid pressure-transmitting path in said circular portions spaced from said gear tooth confronting face region and terminating in locations opening into said gear tooth conforming face region on either side of a line through the centers of said holes, said terminating locations of said paths being circumferentially spaced from said throat areas.

7. The improvement as claimed in claim 6 wherein said terminating locations in each circular portion are equidistant from said line.

8. The improvement as claimed in claim 7 in which said terminating locations of each pressure-transmitting path comprise recesses in said gear tooth-confronting face regions, said recesses being open on the peripheral edges of said plate structure.

9. The improvement as claimed in claim 6, 7 or 8 wherein each said fluid pressure-transmitting paths comprise channels in the outer peripheral edges of said circular portions, said channels being spaced from the faces of said plate structure to provide sealing lands along either side of said channels engageable with the inside walls of a pump or motor housing.

* * * * *